US005081436A

United States Patent [19]

Nishi et al.

[11] Patent Number: 5,081,436

[45] Date of Patent: Jan. 14, 1992

[54] ELECTROMAGNETIC RELAY HAVING AN IMPROVED TERMINAL STRUCTURE

[75] Inventors: Hiroyuki Nishi, Nagaokakyo; Takeshi Suzuki, Kyoto; Masato Nonaka, Takeo, all of Japan

[73] Assignee: Omron Corporation, Kyoto, Japan

[21] Appl. No.: 439,942

[22] Filed: Nov. 22, 1989

[30] Foreign Application Priority Data

| | | | |
|---|---|---|---|
| Nov. 22, 1988 | [JP] | Japan | 63-152010[U] |
| Nov. 22, 1988 | [JP] | Japan | 63-152011[U] |
| Nov. 24, 1988 | [JP] | Japan | 63-153218[U] |
| Nov. 24, 1988 | [JP] | Japan | 63-153219[U] |
| Nov. 24, 1988 | [JP] | Japan | 63-297914 |

[51] Int. Cl.[5] ..... H01H 51/22

[52] U.S. Cl. ..... 335/83; 335/131; 335/132

[58] Field of Search ..... 335/78-85, 335/129-133, 128, 232

[56] References Cited

U.S. PATENT DOCUMENTS

| | | | |
|---|---|---|---|
| 4,490,701 | 12/1984 | Dietrich et al. | 335/78 |
| 4,590,450 | 5/1986 | Blum | 335/129 |
| 4,734,669 | 3/1988 | Maenishi et al. | 335/132 |

*Primary Examiner*—Leo P. Picard
*Assistant Examiner*—Lincoln Donovan
*Attorney, Agent, or Firm*—Fish & Richardson

[57] ABSTRACT

An electromagnetic relay in which terminal pieces carrying fixed contact pieces can be assembled in the case for the electromagnetic relay from above. The case consists of a main case accommodating an electromagnet unit, a terminal case accommodating a contact unit and mounted on the main case, and a cover which is mounted on the terminal case. Each of the terminal pieces is fitted into a mounting position in a certain direction to be made immobile in any other direction perpendicular thereto. The cover is provided with a plurality of projections each of which engages with one of the terminal pieces to prevent it from moving in the said certain direction. Thus, the terminal pieces may be assembled from the upper end of the terminal case, and the work required for this assembly process may be significantly reduced. According to this structure, since the terminal case may be integrally provided with a bottom wall which separates the contact unit in the terminal case from the electromagnet unit accommodated in the main case, a better insulation can be achieved without in any way complicating the assembly process.

8 Claims, 13 Drawing Sheets

ELECTROMAGNETIC RELAY HAVING AN IMPROVED TERMINAL STRUCTURE

TECHNICAL FIELD

The present invention relates to an electromagnetic relay which is easy to assemble and reliable in operation.

BACKGROUND OF THE INVENTION

According to a conventional electromagnetic relay, as illustrated in FIG. 21, a terminal case 103 is mounted on a box-shaped main case 102 accommodating an electromagnet unit 101 therein, and a free end portion 106*a* of an armature 106 which is actuated by the electromagnet unit 101 is engaged with a moveable insulated member 105 for opening and closing contacts in a contact unit 104 incorporated in the terminal case 103 in such a manner that fixed contacts 109 of screw terminal pieces 108 for fixed contacts (FIG. 22) interposed between barriers 107 provided in the terminal case 103 may be opened and closed by moveable contacts 110 carried by the moveable insulated member 105.

According to a conventional structure for mounting the screw terminal pieces 108 between the barriers 107, the screw terminal pieces 108 are inserted from a lower end of the terminal case 103, and are pushed further therefrom towards their free ends until the free ends are placed upon a shelf portion 111 formed in the terminal case 102 as illustrated in FIG. 22.

In this case, the electromagnet unit 101 is inserted into the main case 102 from above and the terminal case 103 is also mounted on the main case 102 from above while the screw terminal pieces 108 are required to be inserted into the terminal case 103 from below, with the result that a considerable amount of effort is required for assembly work, and the screw terminal pieces 108 are not well stabilized as they simply sit on the shelf portion 111. In particular, because the screw terminal pieces 108 are required to be inserted from below, the terminal case 103 must have an open bottom, and it creates the risk of breaking insulation between the contact unit 104 and the electromagnet unit 101 due to the difference in their voltage levels. Therefore, an insulating plate 112 is required to be placed between the terminal case 103 and the main case 102, and this increases the number of component parts and the effort required to assemble it.

BRIEF SUMMARY OF THE INVENTION

In view of such problems of the prior art, a primary object of the present invention is to provide an electromagnetic relay having a terminal piece structure which is easy to assemble.

A second object of the present invention is to provide an electromagnetic relay which is provided with an insulating plate separating a contact piece from an electromagnet unit to achieve a better electric insulation therebetween without requiring a separate member therefor.

A third object of the present invention is to provide an electromagnetic relay which offers a high reliability in its operation without complicating its structure.

According to the present invention, these and other objects can be accomplished by providing an electromagnetic relay, comprising: a main case constructed substantially as a box having an open top to accommodate an electromagnet unit therein; a terminal case having an open top and mounted on the open top of the main case; a plurality of barriers consisting of a plurality of vertical walls provided in mutually parallel relationship in the terminal case; an insulated moveable member slidably received in the terminal case along a first direction perpendicular to the barriers so as to be urged by a spring in the first direction and selectively moved in an opposite direction by an armature of the electromagnet unit against a spring force of the spring; moveable contact pieces carrying moveable contacts and carried by the insulated moveable member; terminal pieces received and fixedly secured between the barriers; a cover member which is mounted on the terminal case; and fixed contact pieces which are integrally connected with the terminal pieces so as to selectively bring fixed contacts carried by the fixed contact pieces into and out of contact with the moveable contacts; the terminal pieces being each provided with an engagement piece which can be fitted into an associated engagement portion of the terminal case in a second direction to thereby limit movement of the terminal piece in any direction perpendicular to the second direction, and the cover being provided with a plurality of engagement portions each for engaging one of the terminal pieces from moving in the second direction whereby the terminal pieces can be fitted into their mounted positions from an end of the terminal case remote from the main casing.

Thus, the screw terminal pieces may be inserted from the upper part of the terminal case to considerably improve the facility of assembling. Furthermore, this structure permits the terminal case to be enclosed at its bottom end with a bottom wall, and this provides a favorable insulation between the contact unit and the electromagnet unit without increasing the necessary number of component parts or the amount of work required for the assembly process.

According to a preferred embodiment utilizing a favorable structure for fixedly securing the terminal pieces, the engagement portions of the cover consist of projections each of which is adapted to be fitted into an associated hole provided in one of the terminal pieces, and the engagement piece of each of the terminal pieces consists of an inverted T-shaped extension thereof provided at its end remote from the fixed contact piece connected thereto so as to be engaged with an associated shoulder portion of the terminal case.

According to a certain preferred feature of the present invention, a base end of the armature is provided with an elongated projection which is received by an associated recess provided in an adjoining end of a yoke of the electromagnet unit so as to form a hinge between the armature and the yoke. According to this structure, since this hinge structure does not require the armature and the yoke to be cut into complicated shapes as opposed to conventional hinge structures, some advantage can be gained in economy of the material and simplicity of the fabrication process. Further, absence of burrs due to elimination of the need for complicated machining processes contributes to the reliability of the operation of the electromagnetic relay, and a large contact area between the armature and the yoke contributes to a reduced magnetic resistance at the hinge portion.

By using an iron core having a non-circular cross section at least at its end adjoining the armature, relative rotation between a bobbin having a flange for securing coil wire ends and the iron core may be prevented, and the reliability of the electromagnetic relay may be improved. Further, by providing a pair of projections for elastically gripping an electronic component part therebetween, an electronic component part associated with the electromagnetic relay may be mounted in a reliable fashion without taking up much space and without complicating the assembly process.

To simplify the structure for mounting the electromagnetic relay on a rail member, a bottom surface of the main case may be provided with a fixed pawl on one side thereof and an elastic pawl on the other side thereof, the elastic pawl being formed in a support portion which is elastically supported by a leg portion projecting perpendicularly from a bottom part of a recess provided in the mounting surface.

BRIEF DESCRIPTION OF THE DRAWINGS

Now the present invention is described in the following in terms of a specific embodiment with reference to the appended drawings, in which.

DETAILED DESCRIPTION OF THE PREFERRED EMBODIMENT

Figure 1:
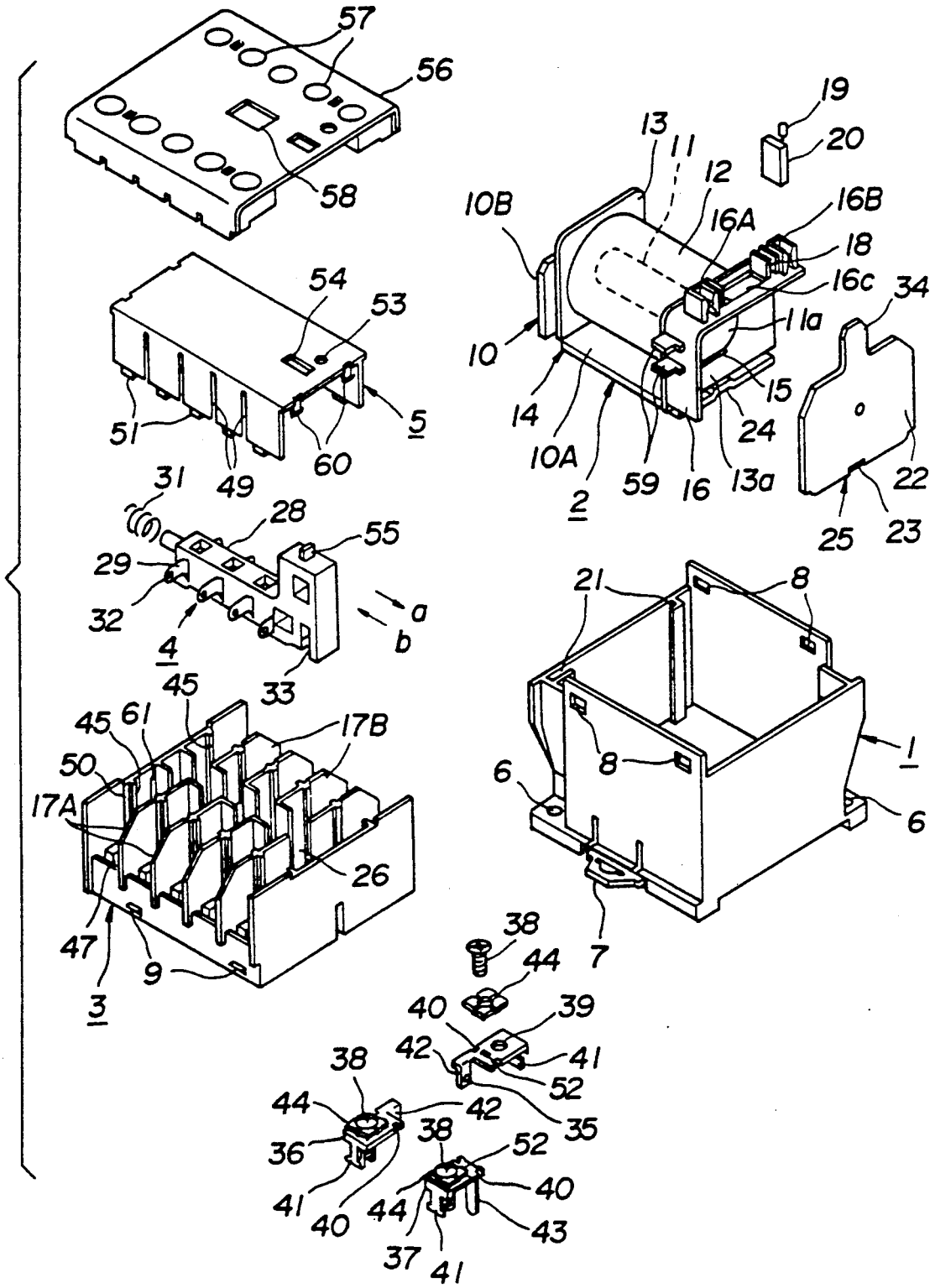
FIG. 1 and 2 are an exploded perspective view and a sectional side view, respectively, of an example of the electromagnetic relay according to the present invention.
Figure 2:
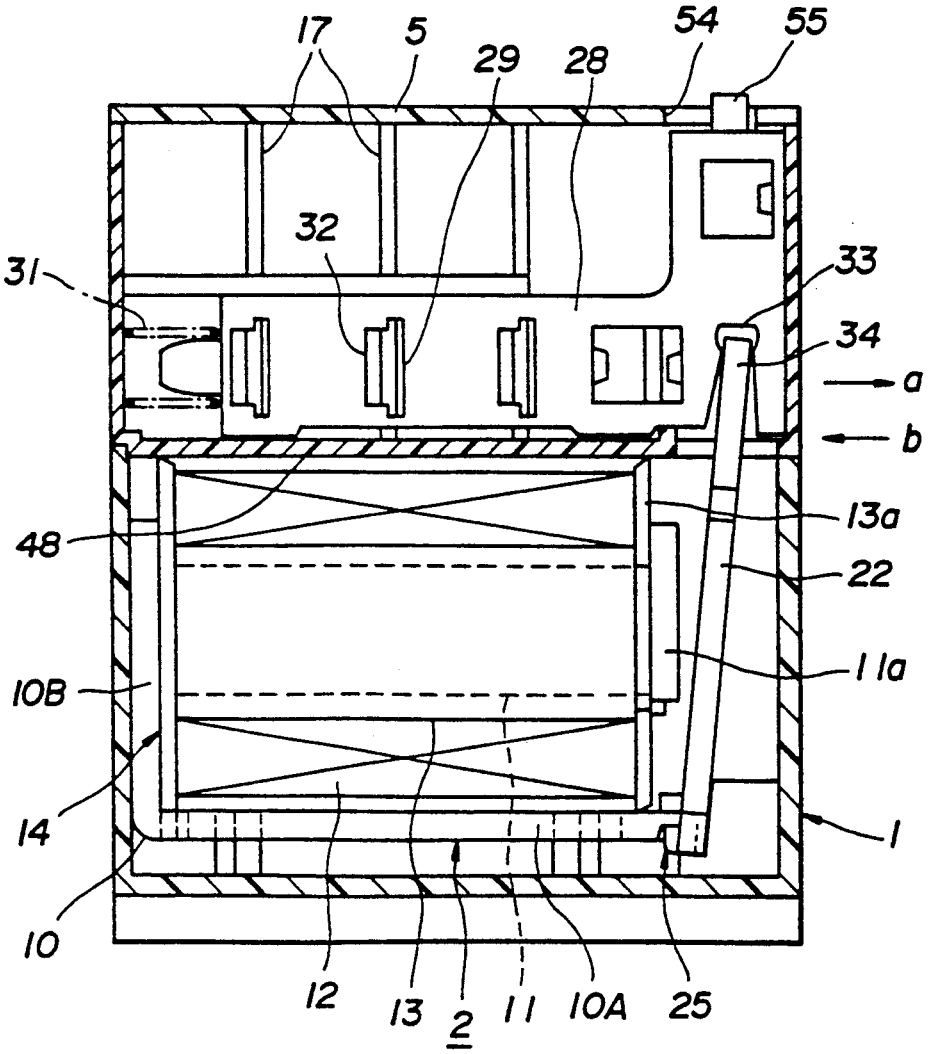

FIGS. 1 and 2 show an example of the electromagnetic relay according to the present invention.

This electromagnetic relay basically consists of a main case 1, an electromagnet unit 2 accommodated in the main case 1, a terminal case 3 mounted upon the main case 1, a contact unit 4 accommodated in the terminal case 3, and a contact unit cover 5 mounted on the terminal case 3.

Referring to these drawings, the main case 1 is formed of a substantially box-shaped member having an open top and made of synthetic resin or the like, and the corner portions of its bottom end are provided with mounting holes 6 while a rail mount structure is visible at its one end as denoted by numeral 7 in FIG. 1. Numeral 8 denotes rectangular openings which are provided in the upper ends of the lateral side walls of the main case 1 to be detachably engaged with engagement projections 9 provided in the terminal case 3.

Figure 4:
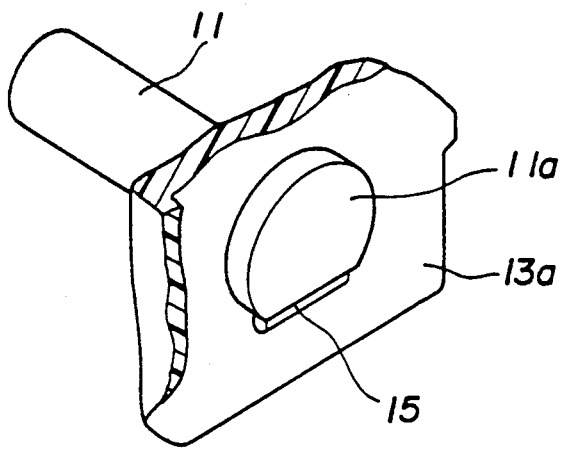
FIG. 4 is a perspective view showing the front magnetic pole portion of the iron core of the electromagnetic relay.
Figure 5:
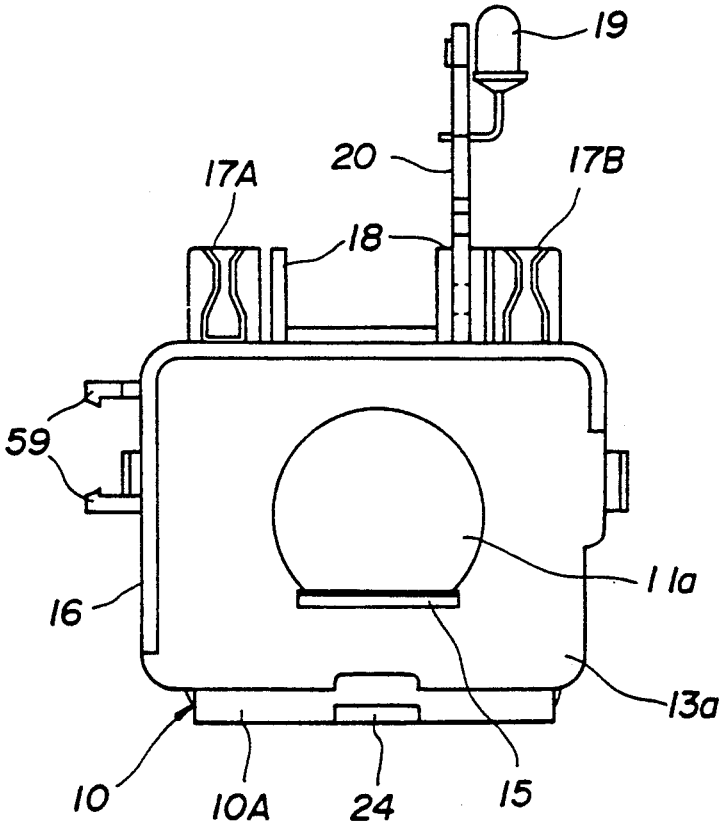
FIG. 5 is a front view of the coil bobbin of the electromagnetic relay.
Figure 6:
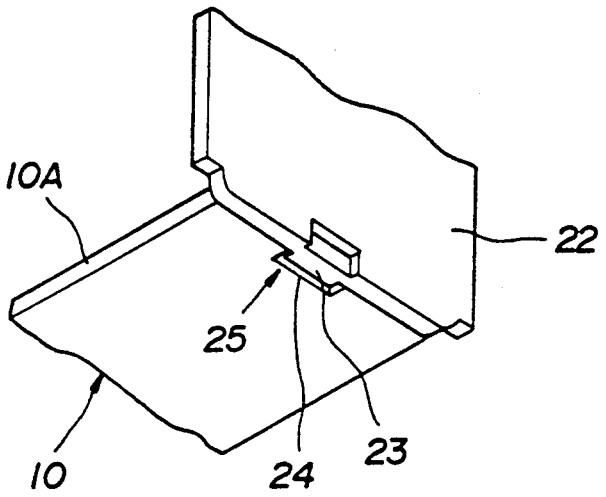
FIG. 6 is a perspective view of the hinge portion of the armature of the electromagnetic relay.

Numeral 10 denotes an L-shaped yoke consisting of a horizontal piece 10A and a vertical piece 10B, and a base end of an iron core 11 is securely attached to the free end of the vertical piece 10B by crimping or other means. Numeral 12 denotes a coil wound around the outer circumferential surface of the iron core 11 by way of a bobbin 13, and an electromagnet block 14 is formed by the yoke 10 and the iron core 11. A free end magnetic pole portion **11*a* of the iron core 11 which is exposed from and fixedly secured to a front flange 13*a* of the bobbin 13 is shaped into a non-circular shape with a portion thereof being removed, as illustrated in FIGS. 4 and 5. A ridge 15 is formed in the front flange 13*a* along the end surface of the removed part of the iron core pole portion 11*a***.

Since the iron core 11 has a non-circular cross section and the bobbin 13 or the front flange **13*a* having a complementary inner bore is fitted thereon, the rotation of the front flange 13*a* relative to the iron core 11 is prevented, and the breaking of the coil lead wire of the coil 12 can be prevented. The shape of the cross section of the iron core 11** is not limited to the illustrated embodiment, but may also be polygonal or other non-circular shapes.

The front flange **13*a* is integrally provided with an L-shaped axial flange 16, and its upper surface is provided with socket terminal portions 16A and 16B and a circuit board retaining piece 18. Numeral 19 denotes a light emitting diode serving as an indicator which is mounted on a circuit board 20 retained by the retaining piece 18, and this light emitting diode 19 may be connected, for instance, across the coil 12. The electromagnet block 14 is securely fixed in the main case 1 by fitting the vertical piece 10B of the yoke 10 into a fitting portion 21 provided in the inner surface of a side wall of the main case 1**.

Numeral 22 denotes an armature which forms the electromagnet unit 2 in cooperation with the electromagnet block 14, and is adapted to be attracted to and repelled from the magnetic pole portion **11*a* of the iron core 11. A central part of the base end portion of the armature 22 is provided with a ridge 23 projecting toward one side thereof or toward the yoke 10 by stamping, and a corresponding groove 24** is formed in a central part of the free end portion of the horizontal piece 10A of the yoke 10 also by stamping so that a hinge portion 25 of the armature 22 may be formed by the ridge 23 and the groove 24. Since this hinge structure does not require the armature 22 and the yoke 10 to be cut into complicated shapes as opposed to conventional hinge structures, some advantage can be gained in economy of the material and simplicity of the fabrication process. Further, absence of burrs due to elimination of the need for complicated machining processes contributes to the reliability of the operation of the electromagnetic relay, and a large contact area between the armature 22 and the yoke 10 contributes to a reduced magnetic resistance at the hinge portion.

Figure 3:
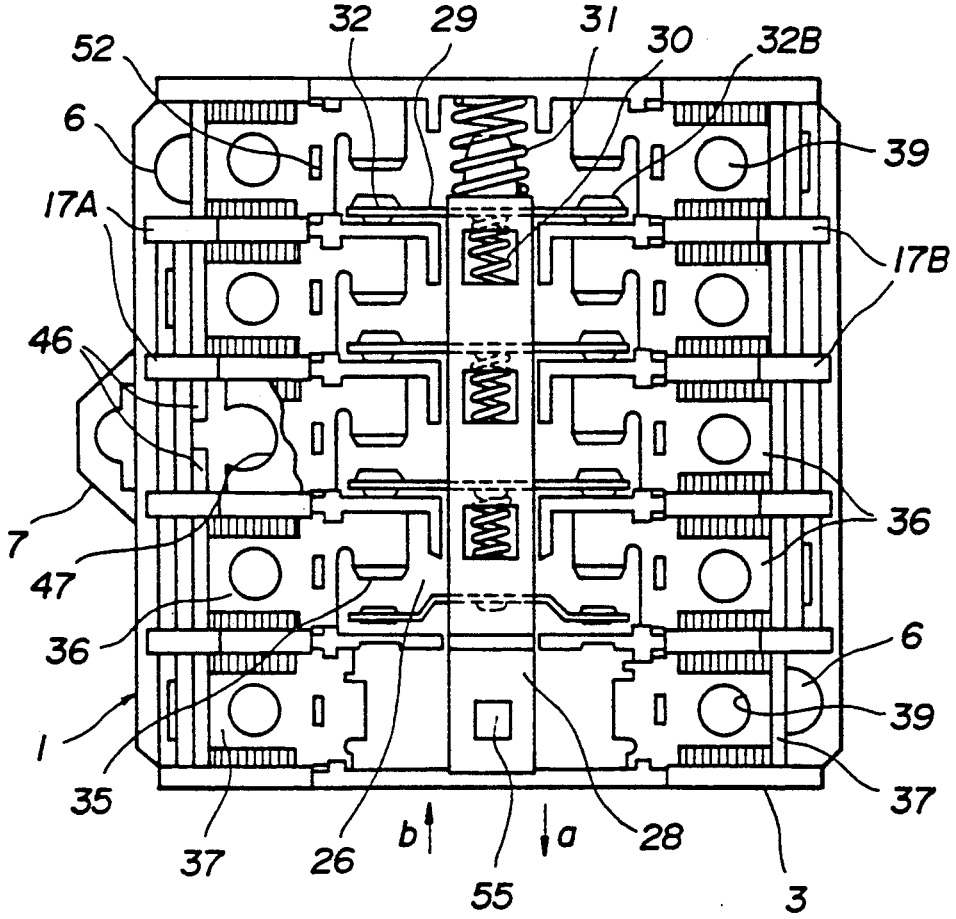
FIG. 3 is a plan view showing the terminal case of the electromagnetic relay with its screws omitted.

The terminal case 3 is made of electrically insulating synthetic resin or the like, and its upper end is provided with a plurality of upright barriers 17A and 17B on either side of a central recess 26 as shown in FIG. 3. Numeral 28 denotes an L-shaped moveable insulated member made of electrically insulating synthetic resin which can be moved along the fore-and-aft direction (as indicated by the arrows *a* and *b* in FIG. 1) within the recess 26, and elastically retains a plurality of moveable contact pieces 29 shaped like wings extending along the lateral direction by means of springs 30 as illustrated in FIG. 3. Numeral 31 denotes a return spring which imparts a forward spring force to the movable insulated member 28. Moveable contacts 32 (32A and 32B) are fixedly attached to either end of each of the moveable contact pieces 29. A recess 33 provided in the lower surface of a front portion of the moveable insulated member 28 engages an actuating piece 34 which projects from a free end of the armature 22 and is passed through a through hole 16C provided in the axial flange 16.

Figure 7:
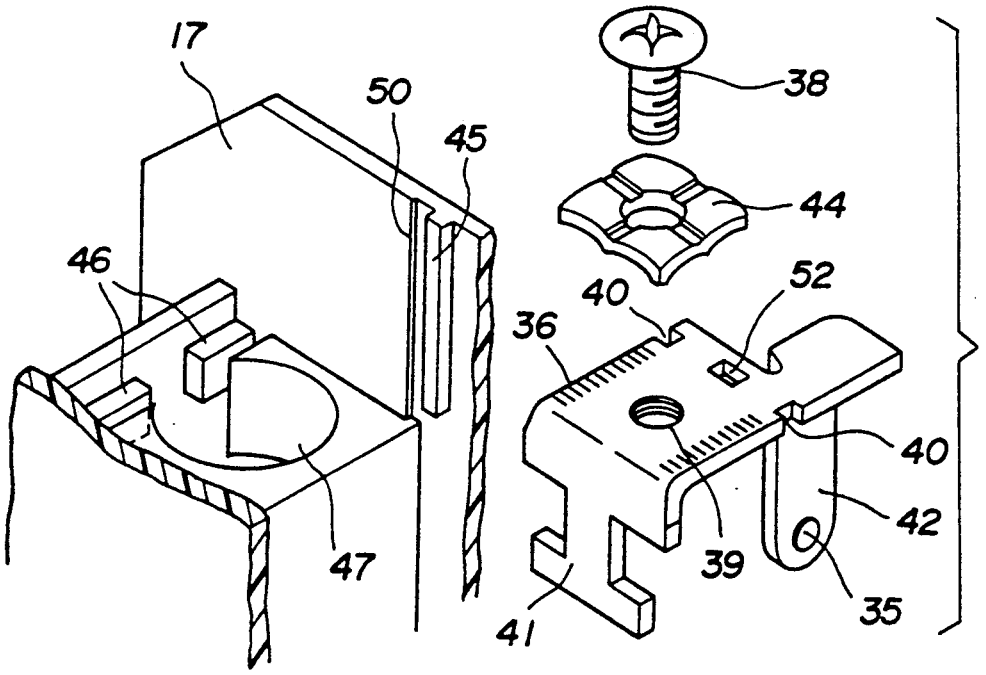
FIG. 7 is a perspective view of the engagement portion of one of the screw terminal pieces of the electromagnetic relay.

Between the barriers 17 are inserted 8 pairs of screw terminal pieces 36 for the contact unit 4 and a pair of screw terminal pieces 37 for power input, from above, and they form a part of the contact unit 4 along with the moveable contact pieces 29 as shown in FIG. 3. The screw terminal pieces 36 and 37 are provided with threaded holes 39 for screws 38 as shown in FIG. 7, and small notches 40 are formed on either side thereof. Inverted T-shaped engagement pieces 36 (37) depend from the free ends of the screw terminal pieces 41. Numeral 42 denotes fixed contact pieces extending from the screw terminal pieces 36, and each of the fixed contact pieces 42 is provided with a fixed contact 35 which cooperates with an associated moveable contact 32 carried by the associated moveable contact piece 29. Numeral 43 denotes coil end connecting pieces extending from the screw terminal pieces 37, and numeral 44 denotes washers.

Figure 8:
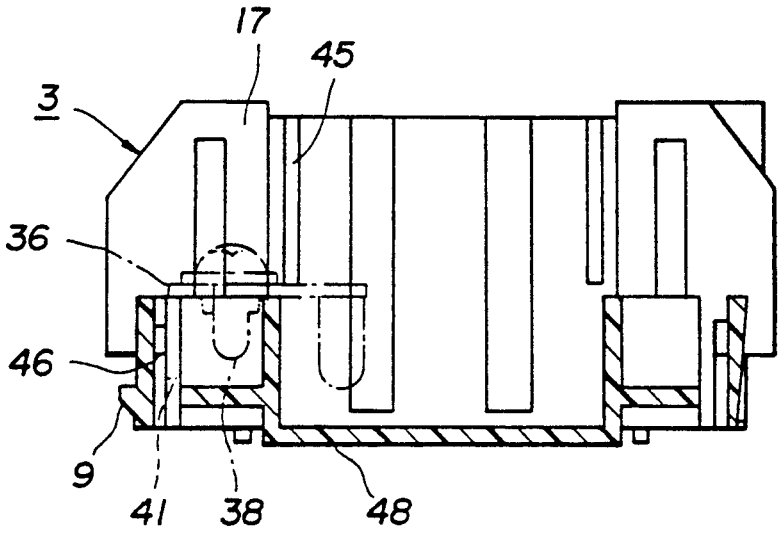
FIG. 8 is a sectional view of the terminal case of the electromagnetic relay.

The mutually opposing surfaces of the barriers 17 are provided with guide ridges 45 for guiding the screw terminal pieces 36 and 37 to the positions indicated by the chain-dot lines in FIG. 8 by engaging their small notches 40 therewith. The inner surfaces of the lateral side walls of the terminal case 3 are provided with shoulder portions or engagement projections 46 (FIG. 7) which engage the inverted T-shaped engagement pieces 41 from both sides, and recesses 26 (FIGS. 3 and 7) are formed between the barriers 17 so as to accommodate the free ends of screws 38 which are threaded with the screw terminal pieces 36 and 37.

The electromagnet unit 2 and the contact unit 4 are separated from each other by the bottom wall 48 of the terminal case 3 serving as an insulating wall (FIG. 2).

Both sides of the contact unit cover 5 are provided with slits 49 so as to correspond to the barriers 17, and the contact unit cover 5 may be mounted on the terminal case 3 by being fitted into vertical grooves 50 (FIG. 7) of the terminal case 3. Numeral 51 denotes projections which are formed at the lower ends of the lateral side walls of the contact unit cover 5 to keep the screw terminal pieces 36 and 37 immobile by engaging engagement holes 52 formed in the screw terminal pieces 36 and 37. Numeral 53 denotes a window provided in the contact unit cover 5 to make the light emitting diode 19 serving as an operation indicator visible from outside, and numeral 54 denotes an opening to expose a projection 55 of the moveable insulated member 28.

Numeral 56 denotes a safety cover which is provided with screw access openings 57 and an indicator window 58, and detachably mounted between the front and rear walls of the terminal case 3.

Numeral 59 denotes a pair of elastic gripping pieces projecting from the axial flange 16 of the bobbin 13 to retain an electronic component.

In FIG. 1, numeral 60 denotes pawls which are integrally formed with the contact unit cover 5 to be engaged by shoulder portions 61 of the terminal case 3.

The operation of the above described structure is now described in the following.

When electric current is supplied to the coil 12 to magnetize it, an attractive force is produced from the front end magnetic pole portion 11*a* of the iron core 11, and the armature 22 is attracted to the iron core 11. As a result, the moveable insulated member 28 which is engaged by the actuating piece 34 on the free end of the armature 22 slides in the direction indicated by the arrow b against the spring force of the return spring 31, thereby causing the moveable contacts 32 to contact the associated fixed contacts 35 and to close the circuit between the screw contact pieces 36 on either side which are connected to the fixed contacts 35. Here, since the moveable contact pieces 29 are retained by the moveable insulated member 28 by way of springs 30, the state of contact between the contacts 32 and 35 are kept in favorable condition even when there is some play in the movement of the moveable insulated member 28. At the same time, the indicator light emitting diode 19 is lighted up so as to indicate the above described operating condition.

When the coil 12 is deenergized, the attractive force between the iron core 11 and the armature 22 is lost, and the moveable insulated member 28 is moved in the direction indicated by the arrow a under the spring force of the return spring 31 to return to its original position.

Since the screw terminal pieces 36 and 37 are so constructed that they may be inserted into the terminal case 3 from above, the assembling of the screw terminals 36 and 37 can be accomplished as a natural part of the processes of placing the electromagnet unit 2 into the main case 1 and mounting the terminal case 3 on the main case 1 both from above. This improves the efficiency of the assembly work.

Figure 9:
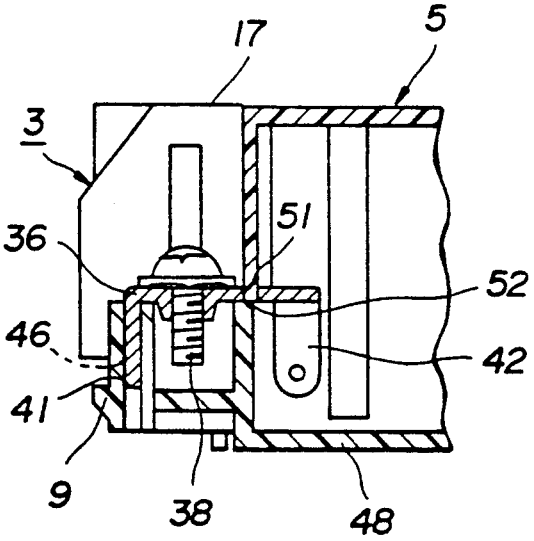
FIG. 9 is a sectional view showing the mounted state of one of the screw terminal pieces of the electromagnetic relay.
Figure 10:
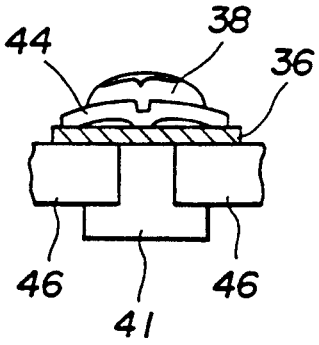
FIG. 10 is an illustrative view of the engaged state of one of the screw terminal pieces.

Then, the screw terminal pieces 36 and 37 are placed between the barriers 17 of the terminal case 3, and are further pushed outwards from the inserted position indicated by the chain-dot lines in FIG. 8 until they reach their prescribed mounting positions shown in FIG. 9. Thus, the screw terminal pieces 36 and 37 are kept at their prescribed positions by the inverted T-shaped engagement pieces 41 being engaged by the engagement projections 46 of the terminal case 3 as illustrated in FIG. 10, and a stable mounted state can be achieved as the movements in both lateral and vertical directions are positively prevented. In other words, the movement of the screw terminal pieces 36 and 37 in any direction perpendicular to the direction along which the screw terminals 36 and 37 were inserted to the mounting positions is prevented. Furthermore, since the projections 51 of the contact unit cover 5 fit into the engagement holes 52 of the screw terminal pieces 36 and 37, the movement of the screw terminal pieces 36 and 37 from their mounting positions along the direction they were inserted is effectively prevented. Thus, the screw terminal pieces 36 and 37 are prevented from being moved in any direction.

According to this particular embodiment, since the bottom wall 48 of the terminal case 3 separates the interior of the main case 1 from the interior of the terminal case 3 and the exterior of the main case 1, intrusion of dust into the main case 1 is avoided. Further, since recesses 47 are formed in the bottom wall 48 of the terminal case 3 so as to correspond to the screws 38 which are threaded into the screw terminal pieces 36 and 37, even when dust gets into the terminal case 3, it is caught in the recesses 47 and is prevented from migrating to other parts of the electromagnetic relay such as the contacts 32 and 35 where presence of such dust should be avoided.

In particular, because the insulating wall between the electromagnetic unit 2 and the contact unit 4 is formed by the bottom wall 48 of the terminal case 3, a conventional insulating plate is not required, and certain advantages can be obtained in the number of component parts, the facility of assembly work and manufacturing cost.

Figure 11:
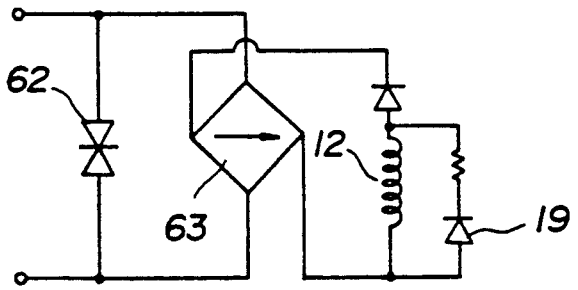
FIG. 11 is a circuit diagram of the circuit included in the electromagnetic relay.
Figure 12:
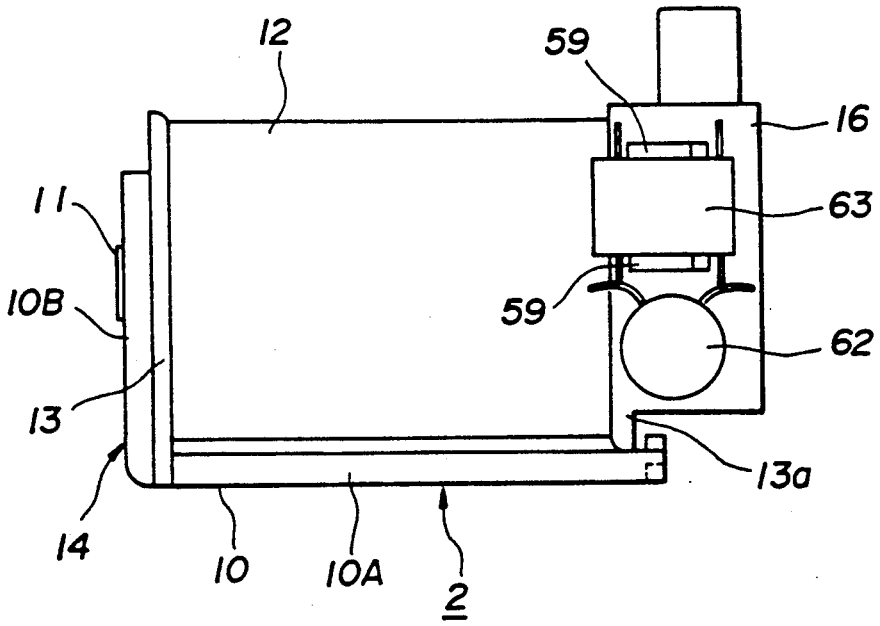
FIG. 12 is a side view of the electromagnet unit showing some of the electronic component parts mounted therefor by means of the gripping pieces integrally provided in the axial flange of the bobbin of the electromagnet unit.

In order to convert 100 Volts AC into the DC voltage to be applied to the coil 12 of the electromagnet unit 2, a circuit including a varistor 62 and a rectifying bridge circuit device 63 such as the one shown in FIG. 11 is typically used. In such a case, by connecting the input leads of the rectifying bridge circuit device 63 in parallel with the leads of the varistor 62, the rectifying bridge circuit device 63 may be retained simply by pushing it between the gripping pieces 59 formed in the axial flange portion 13*a* of the spool 13 as illustrated in FIG. 12. Thereby, the wire ends of the coil 12 may be connected directly to the leads of the rectifying bridge circuit device 63 by soldering, and a circuit board for mounting such a device may be omitted so as to reduce the amount of work and the number of component parts required for the assembly work. Furthermore, the elasticity of the gripping pieces 59 ensures the mounted state of the circuit device 63 to be resistant against vibrations and impacts.

Although the electronic component retained by the gripping pieces 59 was a rectifying bridge circuit element 63 in the above described embodiment, it goes without saying that any other circuit element may be retained thereby depending on each particular circuit structure.

Figure 13:
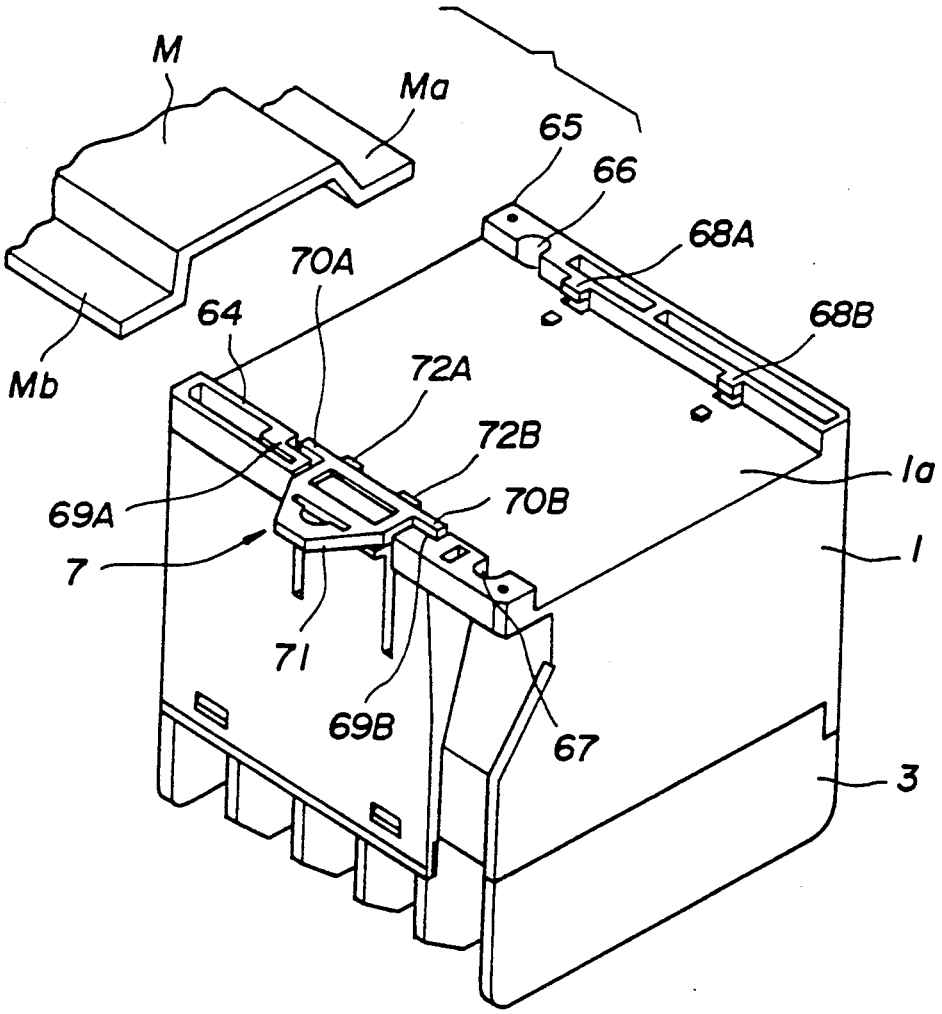
FIG. 13 is a perspective bottom view of the electromagnetic relay showing the structure for mounting the same on a rail member

FIG. 13 is a perspective bottom view of the electromagnetic relay of the present embodiment along with a rail member M on which the electromagnetic relay is to be mounted. The bottom surface 1*a* of the main case 1 is intended as a mounting surface 1*a* for the mounting rail member M, and is provided with the aforementioned rail mount structure 7.

Lateral end portions of the mounting surface 1*a* are provided with projecting walls 64 and 65. Numeral 68 (68A and 68B) denotes fixed engagement pawls projecting from the inner surface of one of the projecting wall 65 for engagement with a side portion Ma of the rail member M.

Figure 14:
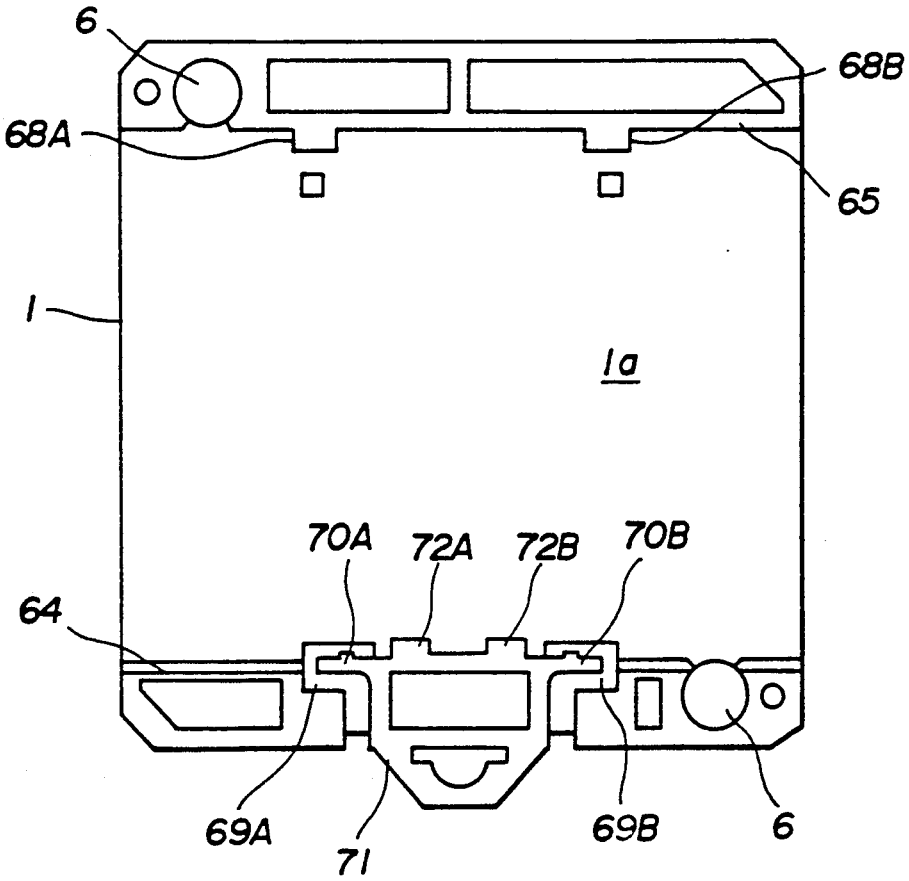
FIG. 14 is a bottom view of the electromagnetic relay.
Figure 15:
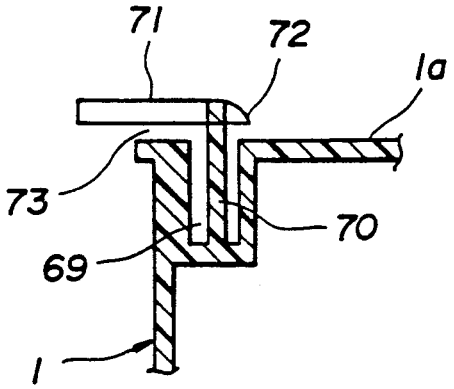
FIG. 15 is a fragmentary section view of the elastic pawl structure.

A central portion of the other projecting wall 64 is provided with a notched part including a pair of trenches 69A and 69B as illustrated in FIGS. 14 and 15. Leg portions 70A and 70B project from the bottom surfaces of the trenches 69A and 69B, respectively, and the free ends of the leg portions 70A and 70B slightly protrude from the plane of the mounting surface 1*a*. Numeral 71 denotes a substantially trapezoidal moveable engagement piece which is bridged across the free ends of the leg portions 70A and 70B so as to be elastically displaced towards and away from the engagement pawls 68 on the opposite projecting wall 65 by way of the leg portions 70A and 70B. The inner end surface of the moveable engagement piece 71 is integrally formed with engagement pawls 72 (72A and 72B) which can detachably engage with the other side portion Mb of the rail member M. In other words, the engagement pawls 68A and 68B serve as substantially fixed pawls while the engagement pawls 72A and 72B serve as elastically displaceable pawls. Numeral 73 denotes a lateral groove defining a gap between the moveable engagement piece 71 and the mounting surface 1*a*.

Now the process of fabricating the mounting device is described in the following in regards to the method of fabricating the moveable engagement piece 71 which is an essential part of the mounting device.

Figure 17:
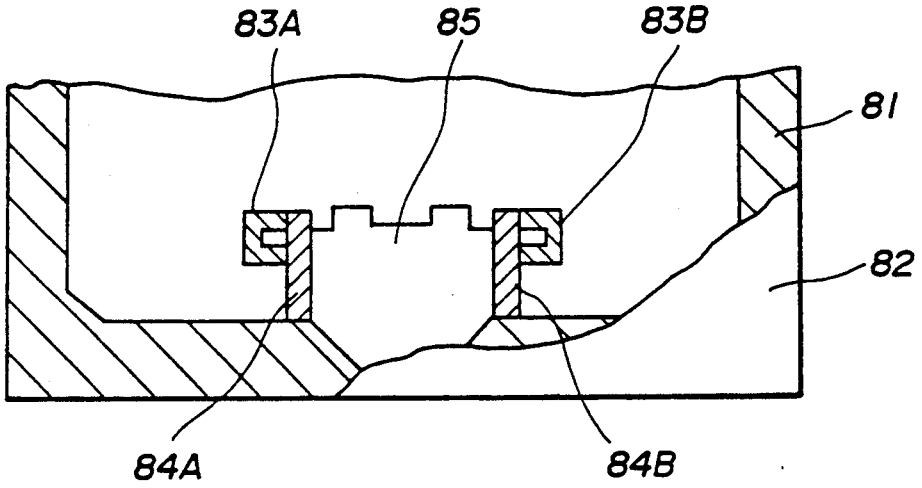
FIG. 17 is a fragmentary sectional plan view of the metallic dies for molding the main case.
Figure 18:
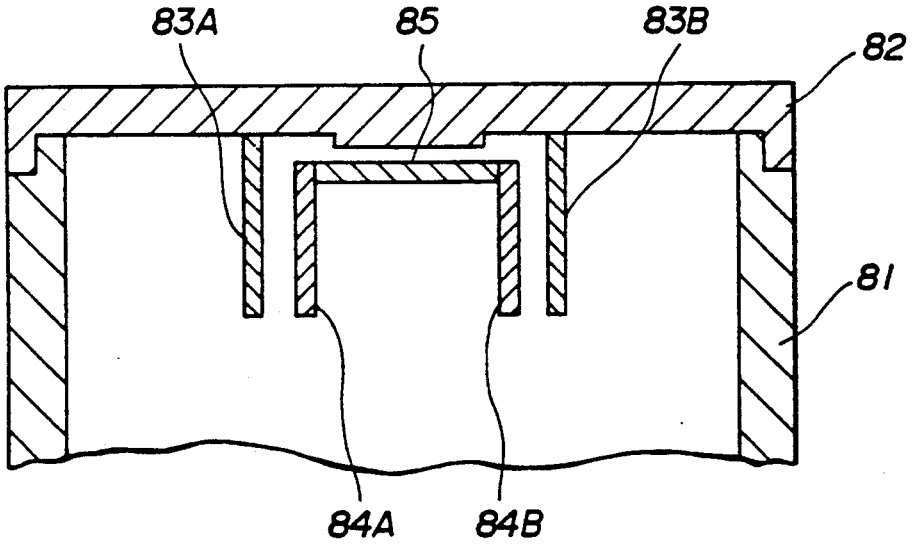
FIG. 18 is a fragmentary sectional side view of the metallic dies for molding the main case.

Referring to FIGS. 17 and 18, metallic dies 81 and 82 for molding the main case 1 accommodates therein first cores 83 (83A and 83B) having a C-shaped cross section serving as first trench forming means for separating, a part of, for instance three sides of the outer circumferential surface of each of the leg portions 70A and 70B projecting from the main case 1. Planar second cores 84 (84A and 84B) serving as second trench forming means for separating the remaining side of the outer circumferential surface of each of the leg portions 70A and 70B is placed vertically with their end portions abutting the opposing surfaces of the first cores 83A and 83B. Further, another planar core 85 serving as a lateral groove forming means for separating the inner side surfaces of the moveable engagement piece 71 is placed horizontally between the second cores 84A and 84B.

Figure 19:
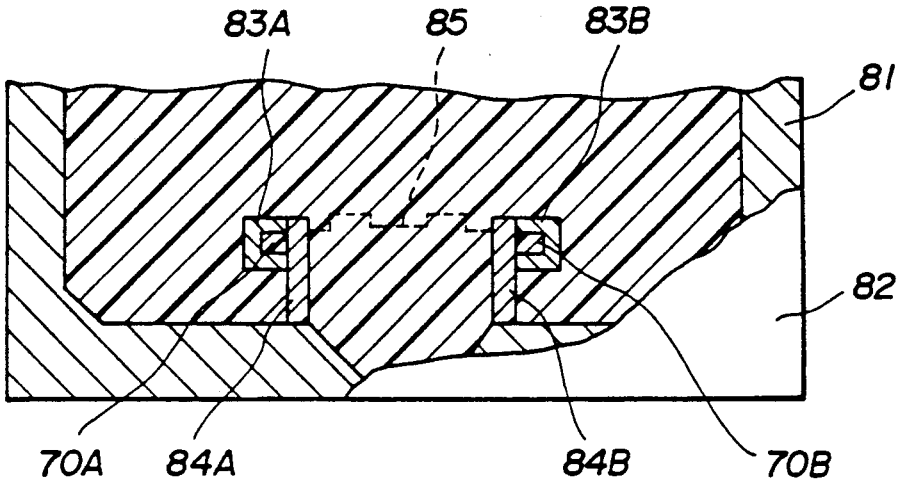
FIGS. 19 and 20 are views similar to FIGS. 17 and 18, respectively, with synthetic resin filled into the cavity defined by the metallic dies.
Figure 20:
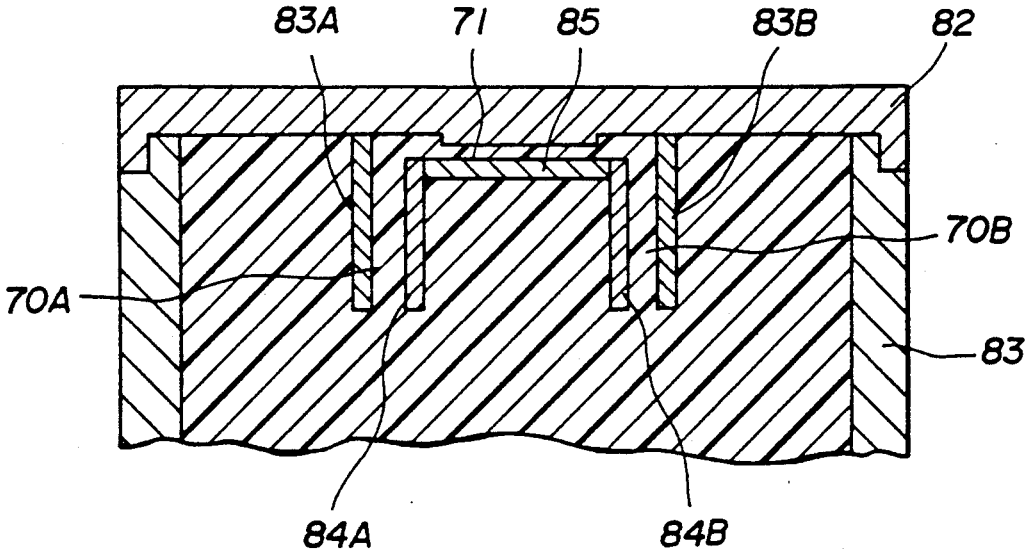
Figure 21:
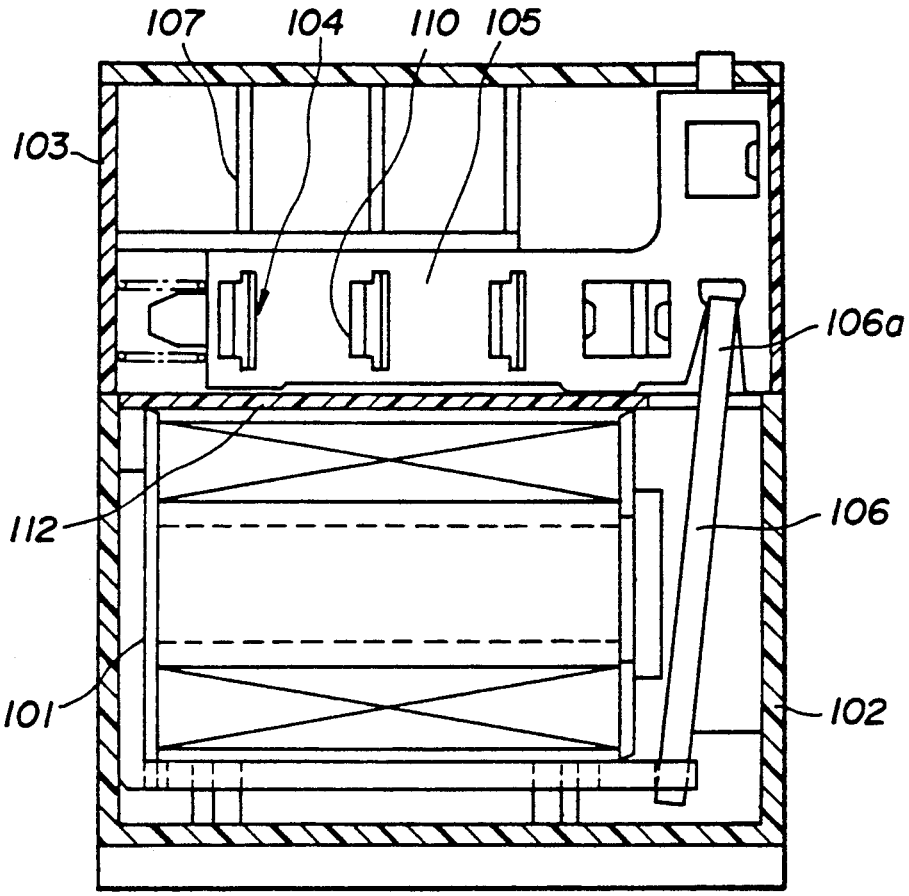
FIG. 21 is a sectional side view of a conventional electromagnetic relay.
Figure 22:
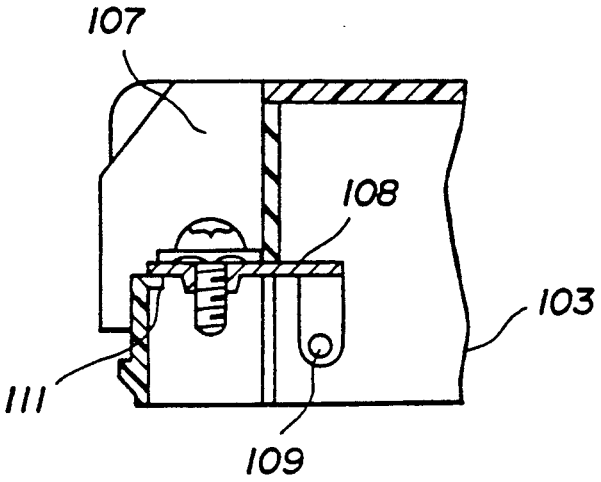
FIG. 22 is a sectional view of one of the screw terminal pieces of the conventional electromagnetic relay.

When synthetic resin is filled into the metallic dies 81 and 82 and is cured therein, the main case 1 is formed while the recess defined by the first cores 83 and the second cores 84 forms the leg portions 70A and 70B which are separated from the main case 1 by the trenches 69 as shown in FIGS. 19 and 20. At the same time, the moveable engagement piece 71 is formed by the third core 85 so as to extend between the leg portions 70A and 70B and be separated from the mounting surface 1*a* by way of the lateral groove 73.

Figure 16:
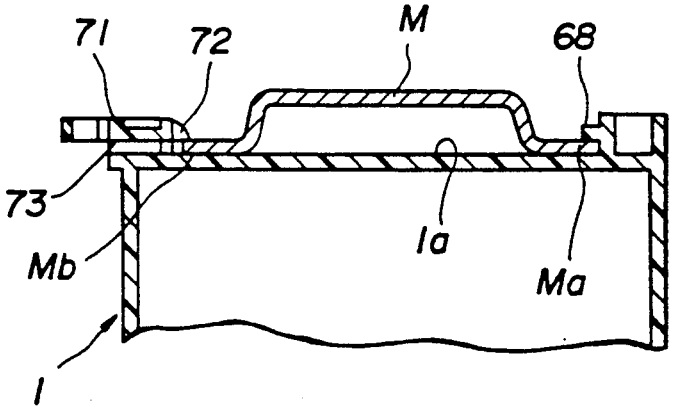
FIG. 16 is a fragmentary sectional view showing the the relationship between the mounting surface of the electromagnetic relay and the rail member.

In the above described structure, when the fixed engagement pawls 68A and 68B on one side of the main case 1 are engaged with one of the side portions Ma of the rail member M and the electromagnetic relay is pushed inwards with the pawls 72A and 72B of the moveable engagement piece 71 disposed so as to abut the other side portion Mb of the rail member M as shown in FIG. 16, the moveable engagement piece 71 elastically deforms in the outward direction, and the pawls 72A and 72B are engaged with the other side portion Mb of the rail member M. As a result, an elastic force of the leg portions 70A and 70B of the moveable engagement piece 71 is applied to the other side portion Mb of the rail member M to thereby fixedly secure the electromagnetic relay.

Since the moveable engagement piece 71 is integrally formed with the main case 1 by way of the leg portions 70A and 70B, the number of component parts is reduced and the assembly work is simplified as compared with a conventional structure using a moveable engagement plate which is separately molded. Furthermore, since the leg portions 70A and 70B project from the bottom surface of the vertical grooves 69A and 69B, the necessary mounting space may be less than that for the structure in which a support portion for a moveable engagement plate is provided on a side surface of the main case 1.

By molding the moveable engagement piece 71 and the leg portions 70A and 70B so as to be separated from the main case 1 by the trenches 69 and the lateral groove 73 by using the first, second and third cores 83, 84 and 85 accommodated in the metallic dies 81 and 82 for the main case 1, the moveable engagement piece 71 and the leg portions 70 may be molded at the same time as molding the main case 1, and the efficiency of fabrication can be significantly improved.

Although the moveable engagement piece 71 was supported by a pair of leg portions 70A and 70B in the above described embodiment, the moveable engagement piece 71 may be supported by a single leg portion 70.

What we claim is:

1. An electromagnetic relay, comprising:

a main case constructed substantially as a box having an open top to accommodate an electromagnet unit therein;

a terminal case having an open top and mounted on said open top of said main case;

a plurality of barriers consisting of a plurality of vertical walls provided in mutually parallel relationship in said terminal case;

an insulated moveable member slidably received in said terminal case along a first direction perpendicular to said barriers so as to be urged by a spring in said first direction and selectively moved in an opposite direction by an armature of said electromagnet unit against a spring force of said spring;

moveable contact pieces carrying moveable contacts and carried by said insulated moveable member;

terminal pieces which are received and fixedly secured between said barriers;

cover member which is mounted on said terminal case; and fixed contact pieces extending from said terminal pieces so as to selectively bring fixed contacts carried by said fixed contact pieces into and out of contact with said moveable contacts;

said terminal pieces being each provided with an engagement piece which can be fitted into an associated engagement portion of said terminal case in a second direction to thereby limit movement of said terminal piece in any direction perpendicular to said second direction, and said cover being provided with a plurality of engagement portions each for engaging one of said terminal pieces from moving in said second direction whereby said terminal pieces can be fitted into their mounted positions from an end of said terminal case remote from said main casing.

2. An electromagnetic relay according to claim 1, wherein said terminal case is provided with a bottom wall separating said fixed and moveable contact pieces from said electromagnet unit.

3. An electromagnetic relay according to claim 1, wherein said engagement portions of said cover consist of projections each of which is adapted to be fitted into an associated hole provided in one of said terminal pieces.

4. An electromagnetic relay according to claim 1, wherein said engagement piece of each of said terminal pieces consists of an inverted T-shaped extension thereof provided at its end remote from the fixed contact piece connected thereto so as to be engaged with an associated shoulder portion of said terminal case.

5. An electromagnetic relay according to claim 1, wherein a base end of said armature is provided with an elongated projection which is received by an associated recess provided in an adjoining end of a yoke of said electromagnet unit so as to form a hinge between said armature and said yoke.

6. An electromagnetic relay according to claim 1, wherein said electromagnet unit comprises an iron core having a noncircular cross section at least at its end adjoining said armature, and a part of a bobbin fitted on said iron core is provided with a complementary inner bore which is closely fitted on said end of said iron core having said noncircular cross section.

7. An electromagnetic relay according to claim 1, wherein said bobbin is provided with a pair of projections for elastically gripping an electronic component part therebetween.

8. An electromagnetic relay according to claim 1, wherein a bottom surface of said main case is provided with a fixed pawl on one side thereof and an elastic pawl on the other side thereof, said elastic pawl being formed in a support portion which is elastically supported by a leg portion projecting perpendicularly from bottom a part of a recess provided in said mounting surface.

* * * * *